US011933594B2

(12) United States Patent
Dubois et al.

(10) Patent No.: US 11,933,594 B2
(45) Date of Patent: Mar. 19, 2024

(54) FUZE COMPRISING A SELF-DESTRUCTION DEVICE FOR A GYRATORY PROJECTILE

(71) Applicant: DIXI MICROTECHNIQUES, Marchaux-Chaudefontaine (FR)

(72) Inventors: Sébastien Dubois, Besancon (FR); Philippe Guyon, Besancon (FR); Florent Lemercier, Besancon (FR)

(73) Assignee: DIXI MICROTECHNIQUES, Marchaux-Chaudefontaine (FR)

( * ) Notice: Subject to any disclaimer, the term of this patent is extended or adjusted under 35 U.S.C. 154(b) by 35 days.

(21) Appl. No.: 17/917,784

(22) PCT Filed: Apr. 30, 2021

(86) PCT No.: PCT/EP2021/061384
§ 371 (c)(1),
(2) Date: Oct. 7, 2022

(87) PCT Pub. No.: WO2022/002462
PCT Pub. Date: Jan. 6, 2022

(65) Prior Publication Data

US 2023/0133860 A1 May 4, 2023

(30) Foreign Application Priority Data

Jul. 2, 2020 (FR) ..... 2006757

(51) Int. Cl.
*F42C 9/18* (2006.01)
*F42C 9/16* (2006.01)
(Continued)

(52) U.S. Cl.
CPC ..... *F42C 9/18* (2013.01); *F42C 9/16* (2013.01); *F42C 15/188* (2013.01); *F42C 15/44* (2013.01)

(58) Field of Classification Search
CPC .... F42C 9/16; F42C 9/18; F42C 15/44; F42C 15/188; F42C 15/196
(Continued)

(56) References Cited

U.S. PATENT DOCUMENTS 3,985,079 A * 10/1976 Post ..... F42C 15/285 102/277
6,237,495 B1 * 5/2001 Hok ..... F42C 15/188 102/236
(Continued)

FOREIGN PATENT DOCUMENTS

DE 102013000050 B3 1/2014
EP 1500902 A1 * 1/2005 ..... F42C 15/005
(Continued)

OTHER PUBLICATIONS

Machine translation of EP-1500902-A1 (Year: 2005).*
Search Report and Written Opinion, Application No. PCT/EP2021/061384, dated Jul. 2, 2021.

*Primary Examiner* — James S Bergin
(74) *Attorney, Agent, or Firm* — MARSHALL, GERSTEIN & BORUN LLP

(57) ABSTRACT

The invention relates to a fuze for a gyratory projectile, including a striker holder movable about a rocker axis perpendicular to the axis of symmetry of the fuze, a primer holder rotatable about an axis of rotation parallel to the axis of symmetry, and a self-destruction device. The latter includes an SD mechanism using the linear acceleration of the projectile upon the departure of the shot to store axial kinetic energy, and a safety mechanism using the centrifugal effects of the projectile during the flight to store radial kinetic energy. The two mechanisms cooperate with each other, and with the striker holder and the primer holder to generate the different storage positions before firing, intermediate upon the departure of the shot, cocked during the
(Continued)

flight and of self-destruction at the end of the flight, guaranteeing maximum safety of the projectile in the storage position and maximum responsiveness of the projectile regardless of the scenario encountered during ballistic firing.

13 Claims, 8 Drawing Sheets

(51) Int. Cl.
*F42C 15/188* (2006.01)
*F42C 15/44* (2006.01)

(58) Field of Classification Search
USPC ..... 102/231–236, 237–252, 265–271
See application file for complete search history.

(56) References Cited

U.S. PATENT DOCUMENTS 8,037,826 B2 * 10/2011 Taylor ..... F42C 15/188
102/222
8,342,093 B2 * 1/2013 Westphal ..... F42C 15/188
102/253

FOREIGN PATENT DOCUMENTS

FR 2364429 A1 4/1978
FR 2489956 A1 3/1982
WO WO-2007137444 A1 12/2007

* cited by examiner

FUZE COMPRISING A SELF-DESTRUCTION DEVICE FOR A GYRATORY PROJECTILE

TECHNICAL FIELD

The present invention relates to a fuze including a self-destruction device for a gyratory projectile, said fuze consisting of a hollow body, defined by an axis of symmetry coinciding with the axis of rotation of said projectile, and including a striker associated with a striker holder, a primer associated with a primer holder, and a self-destruction device arranged to cooperate with said striker holder and said primer holder to successively generate a first position called "storage position" before firing the projectile, in which the primer is misaligned with respect to the striker, a second position called "intermediate position" upon the departure of the shot, in which the striker holder is away from the primer holder, a third position called "cocked position" during the flight of the projectile, in which the primer is aligned with the striker, and a fourth position called "self-destruction position" at the end of the flight, in which the striker holder is folded down on the primer holder so that the striker hits the primer and initiates the pyrotechnic chain contained in the projectile.

BACKGROUND

In the field of projectiles fired with different firearms, both land and airborne ones, it is known to equip the detonator fuzes (heads of the projectiles including the striker, the primer and the explosive charge) with a self-destruction device intended to cause the explosion of these projectiles after a determined period of time if these have not hit a target, that being so to avoid leaving them cocked in the wild risking exploding at any time and injuring innocent people.

The invention is only concerned with gyratory projectiles, i.e. which are fired by weapons with helically rifled barrels to impart to the projectiles a gyroscopic movement on themselves combined with a linear trajectory.

In this case, the centrifugal force of the projectile during firing could be used to activate mechanical self-destruction devices, releasing the kinetic energy necessary for striking stored beforehand in a spring system, as in the publications EP2102581B1, EP1155279B1, EP1500902B1 and FR2489956B1. Nevertheless, the fact of storing the kinetic energy during the lifetime of the projectile prior to firing (in the storage position) is a permanent source of danger for people and does not comply with the standards in force (STANAG 4187). Furthermore, some of these devices only work with very high rotational speeds, for example 70,000 tr/mn, and are not suitable for lower speeds such as 15,000 tr/mn. In addition, the reliability and the reproducibility of these devices are difficult to control.

One could also use the acceleration of the projectile upon the departure of the shot to activate mechanical self-destruction devices, by storing the kinetic energy necessary for striking upon the departure of the shot, then the centrifugal force of the projectile during firing to maintain the balance of the self-destruction mechanism, as in the publications EP2941620B1 and WO2007137444A1. Even though these self-destruction devices comply with the standards in force (STANAG 4187), they are less responsive in the event of a direct impact, i.e. during normal operation of the fuze. Indeed, they do not have a function of direct impact by deformation of the cap. Furthermore, in the event of an angled impact (for example 60° NATO*), these self-destruction devices may become misaligned or deformed and not operate, or operate in a degraded mode, seriously harming people safety. *(The "NATO degree" with respect is the angle of incidence of the impact of an ammunition to the normal of the target: 0° NATO represents a direct impact on the target, namely an orientation of the ammunition upon impact of 90° with respect to the target).

The invention specifically relates to 40 mm grenades which are grenades that could be fired from a specific barrel, but are not more powerful than hand grenades. 40 mm grenades are standard grenades, but there are also 20 mm and 37 mm grenades for special-purpose weapons. Of course, the invention is not limited to this type of ammunition, and extends to any other gyratory ammunition or projectile.

Current self-destruction devices on this type of grenade are essentially pyrotechnic, as in the example of the publication WO2005111533A1. When firing a grenade, the acceleration and/or the rotation of the departure of the projectile in the barrel actuate a mechanism which will directly initiate a pyrotechnic delay. A pyrotechnic delay is an element containing chemical substances, capable of detonating or deflagrating reaction following a mechanical initiation, often via a striker tip. These devices are not reliable over time because of the pyrotechnic components which are sensitive to humidity and to temperature differences. Hence, they run an uncontrolled risk of obsolescence. The accuracy and reliability of these devices are random and difficult to reproduce. Furthermore, the pyrotechnic delay is characterized by a defined and non-modifiable duration between the moment of its initiation and that of the expected pyrotechnic reaction, often a detonation. Thus, following the departure of the shot (firing of the ammunition or the projectile), the pyrotechnic delay begins the countdown and at the end of its duration detonates. The duration of the pyrotechnic delay is sized so as to enable the projectile to reach a target at maximum distance. In general, the detonation of the main charge of the projectile is initiated by the mechanical action of the impact of the fuze on a target. The self-destruction of the projectile occurs when the target is missed and the impact does not generate a detonation of the main charge. In this case, the projectile falls on the ground and it is the pyrotechnic delay which initiates the main charge at the end of its duration.

Yet, the duration defined by the pyrotechnic delay may be from several seconds to a few tens of seconds depending on the models. The limit of this technology is the direct dependence between the self-destruction of the projectile and a duration defined by the pyrotechnic delay. This dependence decreases the responsiveness of the self-destruction device and could endanger people. Indeed, an ammunition having fallen on the ground after a missed hit will explode a few seconds or a few tens of seconds after having been stabilized on the ground representing a danger for the user who would have progressed and reached the point of fall of the ammunition before the end of the pyrotechnic delay.

SUMMARY OF THE DISCLOSURE

The present invention aims to overcome these drawbacks by proposing a mechanical self-destruction device for a gyratory projectile fuze, meeting the standards in force (STANAG 4187), independent of a duration, without energy storage prior to firing, reactive and flexible, i.e. suitable for all shooting situations, thus capable of guaranteeing a very high level of safety for the user and those around him by eliminating the risk of an active projectile remaining on the ground. The invention also proposes a self-destruction device with a reliable, reproducible design, which could be superposed or combined with other striking means provided in the fuze to further increase its level of reliability.

For this purpose, the invention relates to a fuze of the type indicated in the preamble, characterized in that said striker holder is rotatable about a rocker axis perpendicular to said axis of symmetry, in that said primer holder is movable in rotation about an axis of rotation parallel to said axis of symmetry, in that said self-destruction device includes an SD mechanism and a safety mechanism arranged to cooperate with each other, in that said SD mechanism includes an axial inertial body urged by a return member and arranged to use the linear acceleration of the projectile upon the departure of the shot, store axial kinetic energy and cause the switch from said storage position to said intermediate position in which said mechanism SD releases the striker holder so that it moves away from the primer holder, in that said safety mechanism includes a centrifugal lever urged by a return member and arranged to use the centrifugal effects of the projectile during the flight, store radial kinetic energy and cause the switch from said intermediate position to said cocked position in which said safety mechanism locks said SD mechanism, and in that said safety mechanism is further arranged, at the end of the flight, as soon as the centrifugal force induced by the rotation of the projectile drops below a determined threshold, to cause the switch from said cocked position to said self-destruction position in which said safety mechanism restores the stored radial kinetic energy and unlocks said SD mechanism so that, in turn, said SD mechanism restores the stored axial kinetic energy and folds the striker holder back on the primer holder to strike the primer.

The main advantage of this self-destruction device is its responsiveness. Upon an impact, regardless of the angle of impact, whether this impact is on a target or on the ground, the drop of rotational speed of the projectile is rapid. This sudden drop in rotational speed allows immediate triggering of the self-destruction device, i.e. without inertia, increasing the level of reliability and allowing achieving a very high level of safety for people.

Because of its configuration, this self-destruction device, which is sensitive to the drop of centrifugal effects, could be coupled with a ricochet-type firing system, sensitive to flight deceleration peaks, as well as a device for ignition by deformation of the cap of the fuze in the event of a direct impact, during "normal" operation of the fuze, thus allowing for a maximum responsiveness for all scenarios encountered in the field of ballistics.

In a preferred form of the invention, the inertial body of said SD mechanism extends over an axis parallel to said axis of symmetry so that the rocker axis of said striker holder is positioned between the two axes, said inertial body is movable in its axis between an extended position in which it pushes the striker holder in the direction of the primer holder, and a retracted position in which it releases the striker holder, said extended position corresponding to the storage and self-destruction positions, and said retracted position corresponding to the intermediate and cocked positions, said inertial body is arranged to move in a direction opposite to the direction of linear acceleration of the projectile from an extended position to a retracted position by compressing said return member to store axial kinetic energy upon the departure of the shot, and said return member is arranged to move said inertial body in the opposite direction from a retracted position to an extended position by decompressing to restore said axial kinetic energy stored at the end of firing.

Said striker is advantageously carried at one end of said striker holder located opposite said inertial body with respect to said rocker axis, and said primer holder advantageously includes a housing remote from said primer, said housing being arranged to be aligned on said striker in said storage and intermediate positions, so that in the storage position, said striker holder is folded down towards said primer holder, and said striker enters said housing and blocks said primer holder.

Preferably, said self-destruction device further includes an inertial mass pivotally mounted around said rocker axis, consisting of a part separate from said striker holder, disposed between said inertial body and said striker holder and arranged to transmit to said striker holder either the axial kinetic energy restored by said SD mechanism in said self-destruction position, or the specific kinetic energy that said inertial mass has itself stored and that it restores in the event of strong linear deceleration of said projectile upon an impact.

In the preferred form of the invention, the centrifugal lever of said safety mechanism is pivotally mounted around a pivot axis parallel to said axis of symmetry, between an unlocked position in which it releases the inertial body and a locked position in which it blocks the inertial body in a retracted position, the unlocked position corresponding to said storage and self-destruction positions, and the locked position corresponding to said cocked position, said centrifugal lever is arranged to move radially in one direction from an unlocked position to a locked position under the centrifugal effects of the projectile by compressing said return member to store radial kinetic energy during the flight, and said return member is arranged to move said centrifugal lever in the opposite direction from a locked position to an unlocked position by decompressing to restore said stored radial kinetic energy at the end of firing when the centrifugal force is less than the elastic force of said return member.

The centrifugal lever of said safety mechanism may advantageously include two segments disposed on either side of its pivot axis, a first segment being able to carry a centrifugal mass, and a second segment forming a locking stop to block the inertial body in a retracted position, the pivot axis being close to the axis of said inertial body so that the length of said first segment is greater than the length of said second segment.

The return member of said safety mechanism may consist of a torsion spring mounted on a fastening stud with an axis parallel to said axis of symmetry, and provided with a fixed end relative to the body of said fuze, and a movable end coupled to said centrifugal lever to urge it into the unlocked position.

Said self-destruction device may further include a storage lever pivotally mounted around a pivot axis parallel to said axis of symmetry, between an active position in which it blocks said centrifugal lever in an unlocked position corresponding to said storage position, and a passive position in which it retracts relative to said centrifugal lever when the latter moves into a locked position corresponding to said cocked position.

Said storage lever may advantageously include a blocking lug arranged to block said primer holder in a safety position corresponding to said storage position, when said storage lever is in an active position.

Said storage lever and said centrifugal lever may respectively include self-locking means arranged to cooperate only when said storage lever is in an active position and said centrifugal lever is in an unlocked position.

Said self-locking means may be provided respectively in an end area of said storage lever opposite its pivot axis and in an end area of said centrifugal lever opposite its pivot axis, and said storage and centrifugal could be arranged to pivot about their respective pivot axis in opposite directions of rotation under the effect of said centrifugal force of the projectile. Said self-locking means may include a blocking tooth provided on one of the storage or centrifugal levers, and a blocking notch provided on the other one of the centrifugal or storage levers, the blocking tooth being arranged to escape from the blocking notch when said centrifugal lever moves into a locked position, which is possible only in said cocked position.

In the preferred form of the invention, the body of said fuze includes an impact disc coaxial with the axis of symmetry, disposed between its top and the striker holder, and arranged to deform in the event of direct impact of the projectile on a target, and fold said striker holder back on the primer holder to strike the primer.

BRIEF DESCRIPTION OF FIGURES

The present invention and its advantages will appear better in the following description of several embodiments given as non-limiting examples, with reference to the appended drawings, in which.

DETAILED DESCRIPTION

Figure 1:
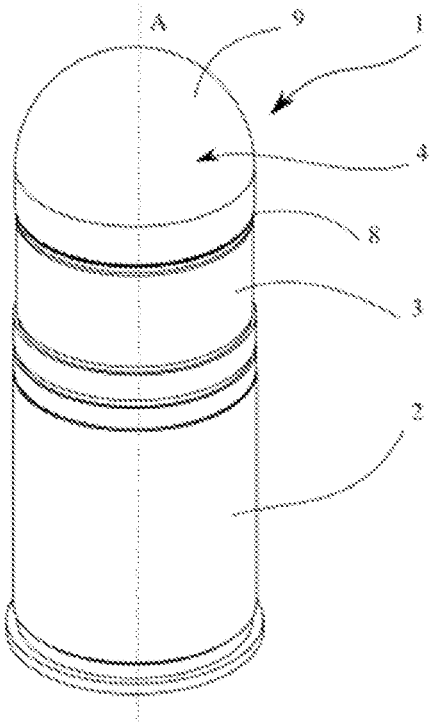
FIG. 1 is a perspective view of a projectile provided with a fuze according to the invention.

In the illustrated embodiment, identical elements or portions bear the same reference numerals. Also, terms that have a relative meaning, such as vertical, horizontal, right, left, front, back, above, below, inside, outside, etc. should be interpreted under normal conditions of use of the invention, and as represented in the figures.

The invention relates more particularly to giratory grenades, which are projectiles 1 having a substantially ogive-like shape, rotating on themselves about an axis of rotation coinciding with the axis of symmetry A of the projectile. This rotation allows for an increased stability of the projectile in flight by gyroscopic effect. In the remainder of the description, the generic term "projectile" is used, which applies to any type of projectile, ammunition, grenades, and the like. The projectile 1 represented in FIG. 1 includes, from bottom to top, a cartridge 2 which contains a propellant charge, an ammunition body 3 which contains an explosive charge, and a fuze 4 which contains a striker 5 associated with a striker holder 14, a percussion primer 6 associated with a primer holder 60 and a self-destruction device 7. These different stages are assembled together by any suitable method, such as crimping, gluing, welding. In the remainder of the description, all or part of the abbreviation "SD" is used to replace the term "self-destruction".

The projectile 1 will not be described in more detail, since it is not the subject of the invention as such. Furthermore, it may have a composition or a constitution other than that described and illustrated in FIG. 1. Similarly, the primer holder 60 will not be described in detail, since it is not the subject of the invention as such, and may have a construction other than that illustrated in FIGS. 13, 14 and 15. In a known manner, the primer holder 60 has a safety function which is ensured by the fact of keeping the primer 6 mechanically misaligned with the pyrotechnic chain. The axis of the pyrotechnic chain coincides with the axis of symmetry A or axis of rotation of the projectile 1. For this reason, it is associated with an actuation mechanism which keeps the primer 6 off-axis or misaligned during the phases of transport, handling and even shooting. It is only after having detected and reacted to the ballistic events of a shot (combined linear and angular accelerations) that the safeties provided in the mechanism allow the primer holder 60 to move.

The invention relates more particularly to the fuze 4 and to the self-destruction device 7 that it contains. This fuze 4 could also be suitable for any type of gyratory projectile. It is represented in partial section in FIG. 2. It includes a hollow body delimiting a closed internal volume, and consists of a substantially cylindrical base 8, and a cap 9 substantially semi-spherical or ogive-like shaped. The cap 9 is superimposed on the base 8 by means of an O-ring 10 (cf. axial section of the base 8 in FIGS. 11 and 12). The two portions 8 and 9 are assembled together by any compatible process, such as crimping, gluing, welding.

The base 8 of the fuze 4 includes at its center a through housing (not represented) to receive the top portion of the ammunition body 3 communicating with the primer 6 allowing initiating a pyrotechnic chain which will activate the explosive charges and cause the destruction of the projectile 1.

The cap 9 of the fuze 4 includes an impact disc 11, coaxial with the axis of symmetry A, arranged in line with the striker 5 and the primer 6 when the SD device is in the cocked position. Upon a direct impact (from 0° to 60° NATO), the cap 9 will deform, thereby resulting in a deformation of the impact disc 11. This impact disc 11 is specially designed so that all possible deformations of the cap generate a sudden descent of the striker 5 in the direction of the primer 6. Indeed, the impact disc 11 has a generally conical shape and deforms always so that its center collapses, presses on the striker 5, which hits the primer 6, which initiates the pyrotechnic chain.

The fuze 4 includes a plate 12 perpendicular to the axis of symmetry A, delimiting in the internal volume of the fuze 4 an upper portion, in which are housed the striker holder 14 and the self-destruction device 7, and a lower portion in which are housed the primer holder 60 and its actuation mechanism.

The self-destruction device 7 of the invention is designed to cooperate with the striker holder 14 and the primer holder 60 to place the projectile 1 in the following successive positions:

a first position called "storage position" in which the projectile 1 is at rest during all of the phases that precede firing, in which the primer 6 is misaligned with respect to the striker 5, a second position called "intermediate position" upon the departure of the shot, in which the striker holder 14 is away from the primer holder 60, a third position called "cocked position" during the flight of the projectile, in which the primer 6 is aligned with the striker 5, and a fourth position called the "self-destruction position" at the end of the flight, in which the striker holder 14 is folded down on the primer holder 60 so that the striker 5 hits the primer 6, initiates the pyrotechnic chain and destroys the bullet 1.

Figure 3:
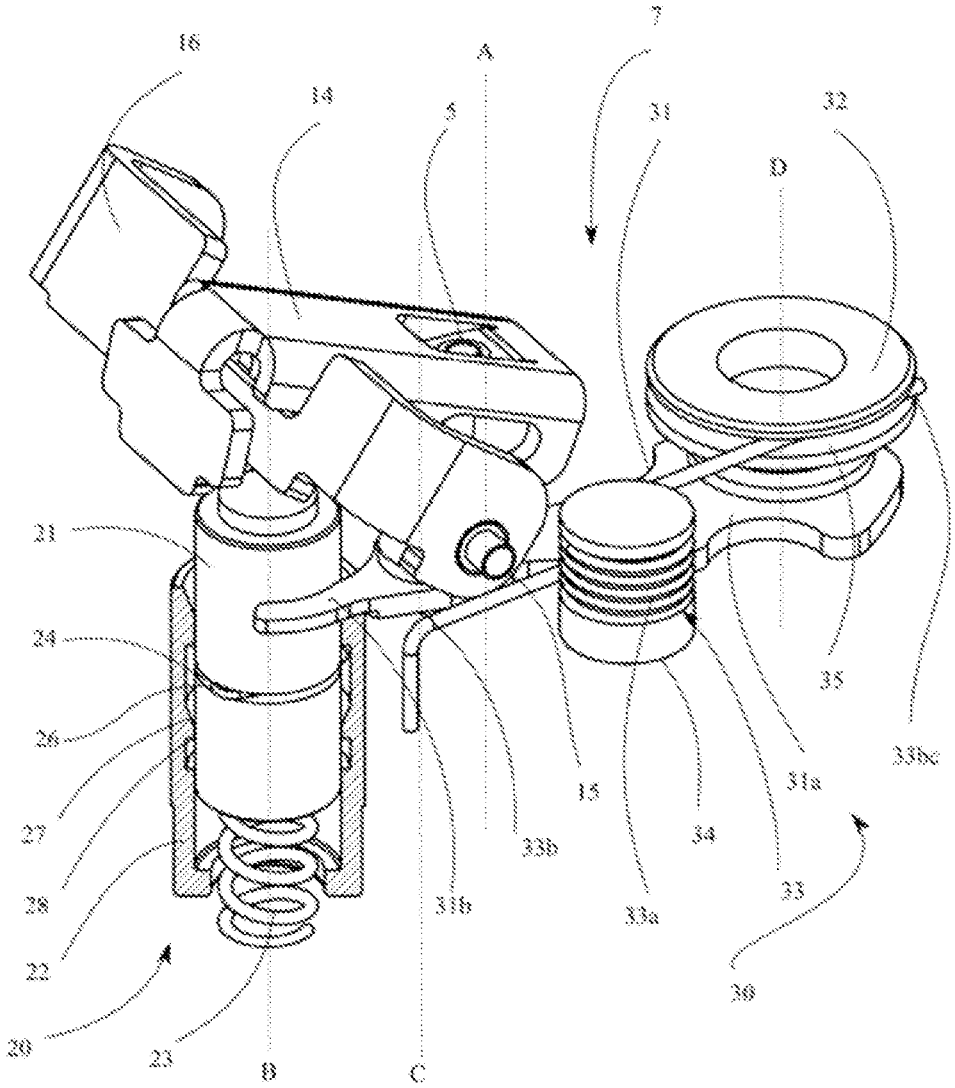
FIG. 3 is a perspective view of the main portions of the self-destruction mechanism alone equipping the fuze of FIG. 2.

In the represented example and with reference to FIG. 3, the striker holder 14 is pivotally mounted around a rocker axis 15 perpendicular to the axis of symmetry A of the fuze 4. It includes at one end located on the side of the primer 6, the striker 5 in the form of a needle. The striker holder 14 could successively adopt:

- a storage position (FIG. 2, 3, 13), corresponding to the storage position of the projectile 1, in which it is not subjected to any stress, it is lowered in the direction of the primer holder 60 and the tip of the striker 5 is received in a housing 61 remote from the primer 6 to prevent the primer holder 60 from rotating and to keep the projectile 1 in a safety position,
- a standby position (FIGS. 11 and 14), throughout the entire duration of the intermediate and cocked positions of the projectile 1, in which it is loaded by the centrifugal effects of the projectile 1, rises and moves away from the primer holder 60, and the striker 5 releases the primer holder 60 which could rotate, and
- a percussion position (FIGS. 12 and 15), in the self-destruction position of the projectile 1, in which it is urged by the SD mechanism 20 (described later on) and lowered in the direction of the primer holder 60 which has rotated to align the primer 6 on the striker 5, and the striker 5 could hit the primer 6 to initiate the pyrotechnic chain.

The striker holder 14 is associated with an inertial mass 16, which is pivotally mounted around the same rocker axis 15, while forming a mechanically separate part. It has the shape of a U-shaped clevis and is positioned below one end of the striker holder 14 opposite to the striker 5. The inertial mass 16 and the striker holder 14 intersect at a right angle. They may include complementary interlocking shapes to be linked together at least temporarily, in particular in the striking position. These complementary interlocking shapes may consist, for example, of an L-shaped end at the end of the striker holder 14 and of a U-shaped recess at the center of the inertial mass 16, without these examples being limiting. The center of gravity of the inertial mass 16 is offset outside the rocker axis 15, i.e. away from the axis of symmetry A of the fuze 4.

Figure 15:
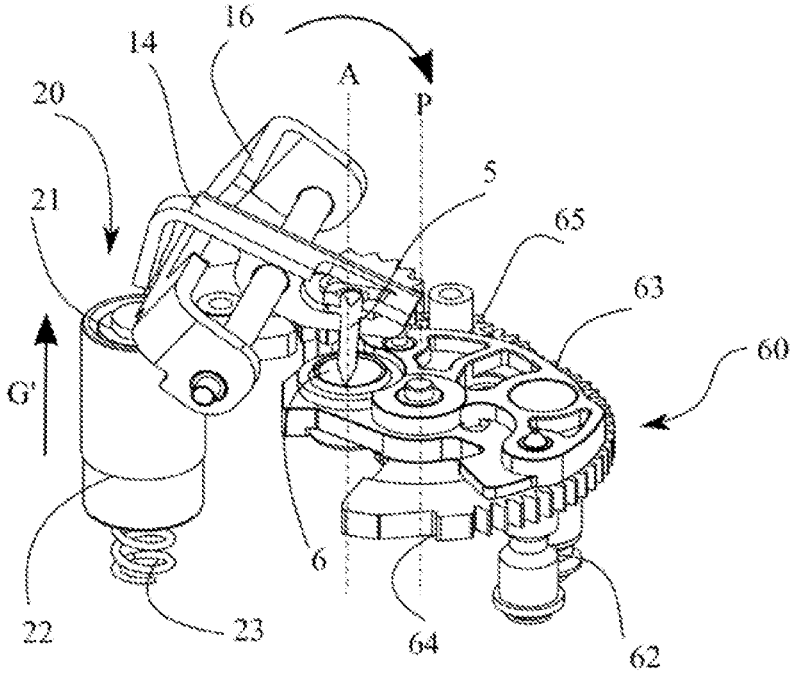
FIG. 15 is a view similar to FIG. 13, in the self-destruction position.

As will be seen later on with reference to FIGS. 12 and 15, it is the inertial mass 16 which transmits to the striker holder 14 the energy necessary for the SD function when this energy is released. But it is also sensitive to the inertia of the projectile 1 to perform a so-called ricochet function, i.e. when the angle of impact of the projectile 1 is larger than 85° NATO (a function sometimes called "Graze effect"). Indeed, its shape and the position of its center of gravity make it extremely sensitive to the axial decelerations of the projectile 1. Its mass enables it to generate a level of energy sufficient to initiate the primer 6. Its role is to further increase the responsiveness of the self-destruction device 7 of the invention. Indeed, if the projectile 1 does not reach its target, and its deceleration is enough, then the inertial mass 16 rises by inertia against the striker holder 14, causes the striker holder 14 to tilt about the rocker axis 15, switching from its standby position to its striking position in which it hits the primer 6. This firing function then short-circuits the self-destruction device 7, which should wait for a drop of the centrifugal effect to engage, as detailed later on.

Upon the initiation of the launch of a projectile 1, called "departure of the shot", ballistic phenomena are transmitted to the fuze 4. These are two combined phenomena of linear acceleration and of angular acceleration. The self-destruction device 7 according to the invention is a mechanical device designed to use these two phenomena as sources of energy for operation thereof. It is activated as of the departure of the shot and stores the energy necessary for the SD function. This energy, called kinetic energy, is mechanically stored upon the departure of the shot and is kept stored by the centrifugal effects throughout the entire flight of the projectile 1. As soon as the rotational speed of the projectile 1 falls below a given threshold, the centrifugal effects are no longer enough to keep the kinetic energy stored. Without the necessary centrifugal effects, the self-destruction stored kinetic energy is then released and the explosive charge is initiated.

Figure 2:
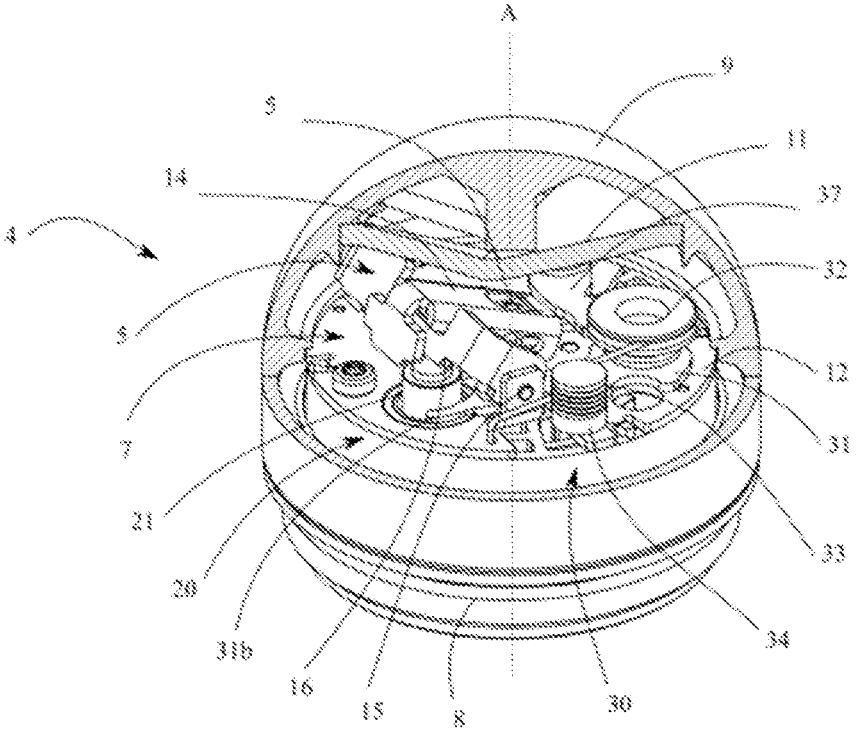
FIG. 2 is a perspective view and in partial section of the fuze of the projectile of FIG. 1, equipped with a self-destruction device according to the invention.

Referring to FIGS. 2 and 3, the self-destruction device 7 includes an SD mechanism 20 arranged to exploit the first phenomenon which is the linear acceleration. It is designed to successively adopt:

- a storage position, which corresponds to the storage position of the projectile 1, in which it keeps the striker holder 14 lowered and prevents the primer holder 60 from rotating,
- a cocked position, throughout the entire duration of the intermediate and cocked positions of the projectile 1, in which it stores kinetic energy under the effect of the linear acceleration of the projectile 1 upon the departure of the shot, and enables the striker holder 14 to rise in a standby position, and
- a self-destruction position in which it restores the stored kinetic energy by moving the striker holder 14 into the striking position to hit the primer 6 as soon as the rotational speed of the projectile 1 falls below a certain threshold.

The self-destruction mechanism 7 further includes a safety mechanism 30 arranged to exploit the second phenomenon which is the angular acceleration. It is designed to successively adopt:

- a storage position, which corresponds to the storage position of the projectile 1, in which it has no effect on the SD mechanism, a locked position, throughout the entire duration of the intermediate and cocked positions of the projectile 1, in which it keeps the SD mechanism in the cocked position under the effect of the centrifugal force induced by the rotational speed of the projectile 1 as of the departure of the shot and throughout the entire duration of the flight, and an unlocked position, in the self-destruction position of the projectile 1, in which it releases the SD mechanism in the self-destruction position as soon as the rotational speed of the projectile 1 falls below a certain threshold.

Referring more particularly to FIGS. 3 to 6, the SD mechanism 20 includes an inertial body 21, a return member 23, a sleeve 22 and a lock 24. The inertial body 21 extends axially over an axis B parallel to the axis of symmetry A of the fuze 4, below and in line with the inertial mass 16. In the represented example, it has a cylindrical shape, without this shape being limiting. The mass and the axial position of the inertial body 21 make it extremely sensitive to the axial acceleration of the projectile 1. Its mass also enables it to generate, in combination with the inertial mass 16, a level of energy sufficient to initiate the primer 6, as explained later on. It is housed in the sleeve 22 which is open-through, itself housed in a blind bore 25 provided in the plate 12 of the fuze 4. The return member 24 is disposed coaxially with the axis B, between the inertial body 21 and the bottom of the blind bore 25. It may consist of a helical spring, without this example being limiting, and is arranged to bias the inertial body 21 upwards in the direction of the inertial mass 16. In the represented example, the lock 24 consists of an elastic ring, trapped in an annular groove 26 formed in a middle area of the inertial body 21. And the sleeve 22 includes in its internal geometry a compression ramp 27 followed by a detent 28 cooperating with the lock 24 as explained hereinafter.

Figure 4:
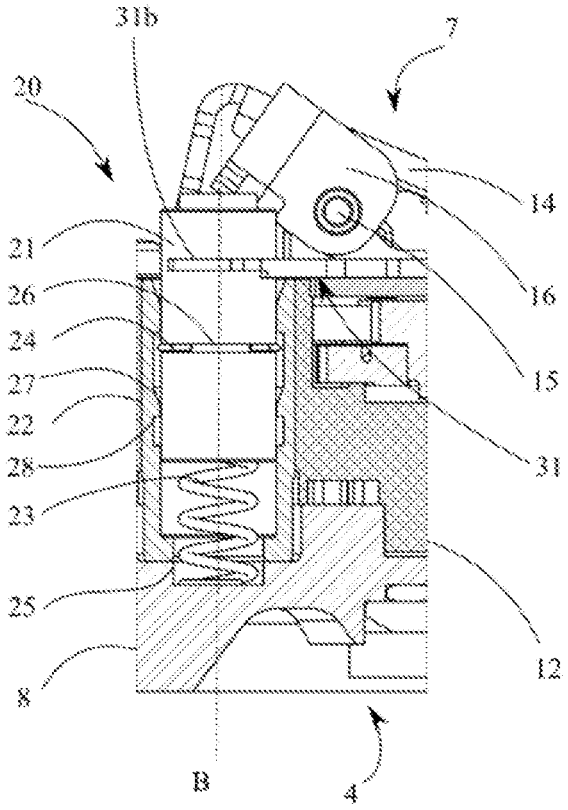
FIG. 4 is an axial sectional view of an SD mechanism forming part of the self-destruction device of FIG. 3, in the storage position.
Figure 5:
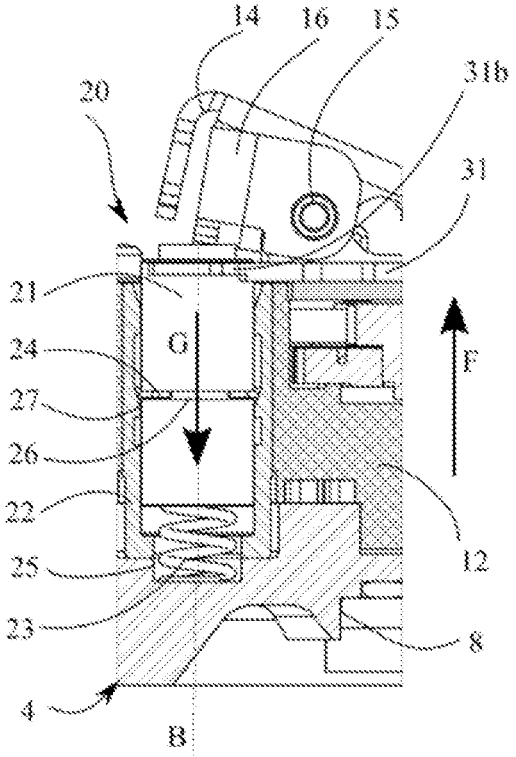
FIG. 5 is a view similar to FIG. 4 of the SD mechanism in an intermediate position.
Figure 6:
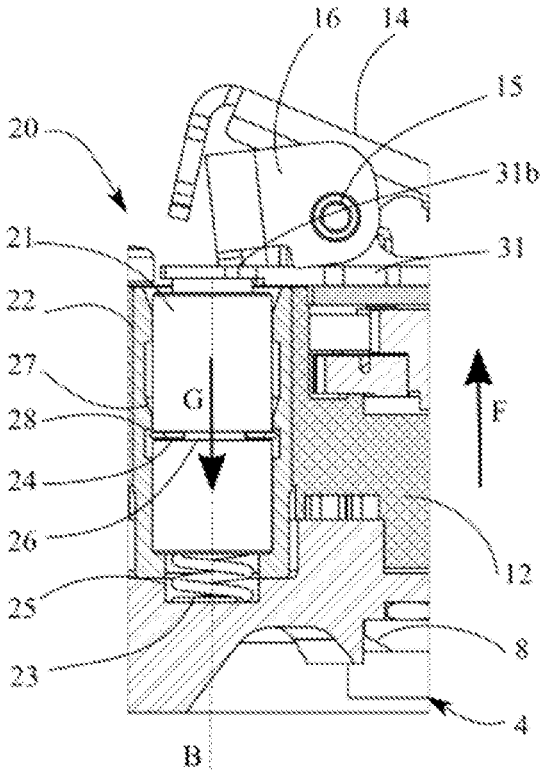
FIG. 6 is a view similar to FIG. 4 of the SD mechanism in the cocked position.

FIGS. 4 to 6 show the kinematics of the SD mechanism 20 switching from a storage position (FIG. 4) to a cocked position (FIG. 6) under the effect of the linear acceleration of the projectile 1 upon the departure of the shot. In the storage position, when the projectile 1 is at rest, the sleeve 22 is pushed into the blind bore 25 of the plate 12, the return member 23 is relaxed and the inertial body 21 protrudes from the plate 12 and in contact with the inertial mass 16, itself in contact with the striker holder 14 held in the lowered position. Upon the departure of the shot, the linear acceleration of the projectile 1 in a direction represented by the arrow F, instantly generates the axial movement of the inertial body 21 in an opposite direction represented by the arrow G against the return member 23 (FIG. 5). During this movement, the inertial body 21 sinks into the sleeve 22, compressing the return member 23 which stores kinetic energy until reaching the cocked position (FIG. 6). In the cocked position, the return member 23 is compressed to its maximum and forms a reserve of kinetic energy capable of ensuring the SD function of the self-destruction device 7. At the same time, the lock 24 embedded with the inertial body 21 descends along the internal wall of the sleeve 22, compresses when passing the compression ramp 27 (FIG. 5), and then relaxes at the detent 28 to fix the cocked position of the SD mechanism 20 (FIG. 6). The inertial body 21 and the sleeve 22 are then intimately linked by the lock 24 and form an inseparable whole. In the event of loss of linear acceleration, the inseparable "inertial body 21 and sleeve 22" assembly will rise under the effect of the return member 23, as explained with reference to FIG. 12. The sleeve 22 and the lock 24 are not essential, but form an additional safety.

Indeed, the fact of separating these two parts: the inertial body 21 and the sleeve 22, enables the self-destruction device 7 to guarantee both that no energy is stored in the fuze 4 before the departure of the shot but also that the SD mechanism 20 is always locked by the locking lever 31 described hereinafter, regardless of the firing situation. In addition, in the storage position, when the self-destruction device 7 is in safety, the protruding position of the inertial body 21 prevents the locking lever 31 from rotating (FIGS. 3 and 4). The angular acceleration has no effect on the locking lever 31 as long as the inertial body 21 has not sunk into the sleeve 22 under the effect of the linear acceleration upon the departure of the shot. This safety requires a combination of both ballistic phenomena simultaneously to be lifted: linear acceleration for the inertial body 21 and centrifugal effect for the locking lever 31.

Referring now to FIGS. 3 and 7 to 9, the safety mechanism 30 includes a locking lever 31, a centrifugal mass 32 and a return member 33. The locking lever 31 is a flat part which is elongated in a plane perpendicular to the axis of symmetry A of the fuze 4. It is pivotally mounted around a pivot axis C parallel to and away from the axis of symmetry A, disposed in the environment close to the SD mechanism 20. It includes two segments disposed on either side of its pivot axis C: a first segment 31*a* which carries at its end the centrifugal mass 32 and a second segment 31*b* which forms a locking stop by overlapping above the inertial body 21 of the SD mechanism 20 when it is in the cocked position (FIG. 6). The length of the first segment 31*a* is larger than the length of the second segment 31*b*, to increase the lever arm on the side of the centrifugal mass 32. The centrifugal mass 32 has a cylindrical shape with an axis D, without this shape being limiting. Its shape, its mass and its position away from the axis of symmetry A make it particularly sensitive to the centrifugal force of the projectile 1. In the represented example, the return member 33 consists of a torsion spring, the central portion 33*a* of which is mounted on a stud 34 fastened on the plate 12, forming with the pivot axis C of the locking lever 31 and the axis D of the centrifugal mass 32 a triangle. One of the end branches 33*b* of the return member 33 is fastened to the plate 12 and the other end branch 33*c* is coupled to the centrifugal mass 32. To this end, it includes an annular groove 35 in which the end branch 33*c* is in sliding contact. This return member 33 is intended to urge the locking lever 31 into the unlocking position (FIGS. 10 and 12).

Figure 7:
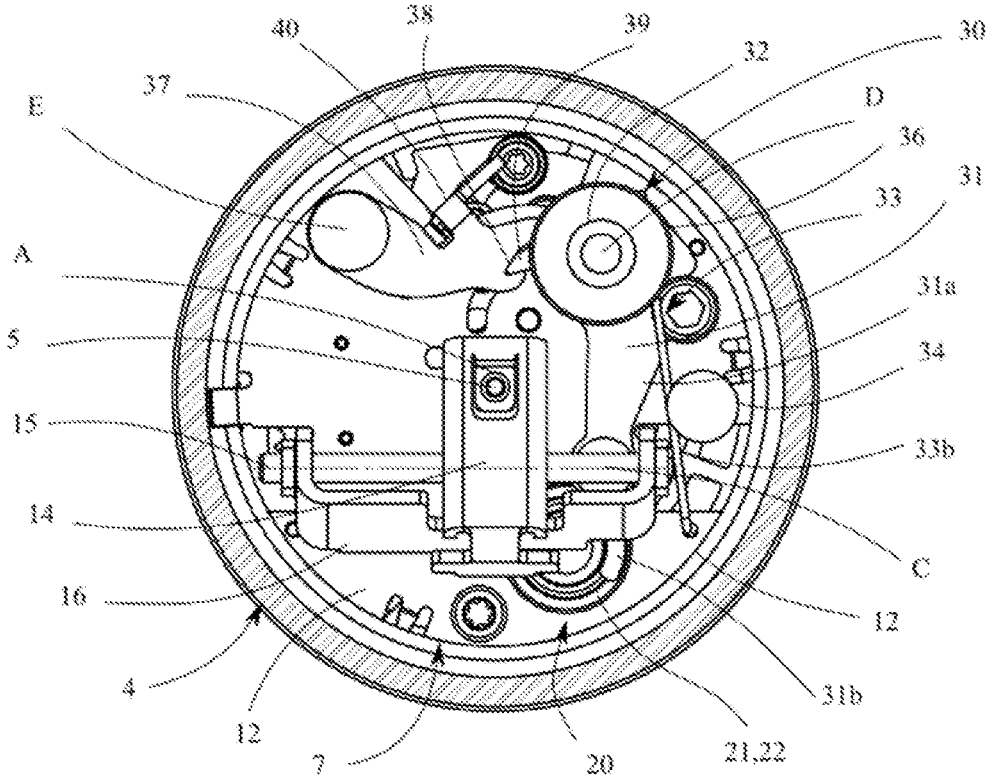
FIG. 7 is a top view of a safety mechanism forming part of the self-destruction device of FIG. 3, in the storage position.
Figure 8:
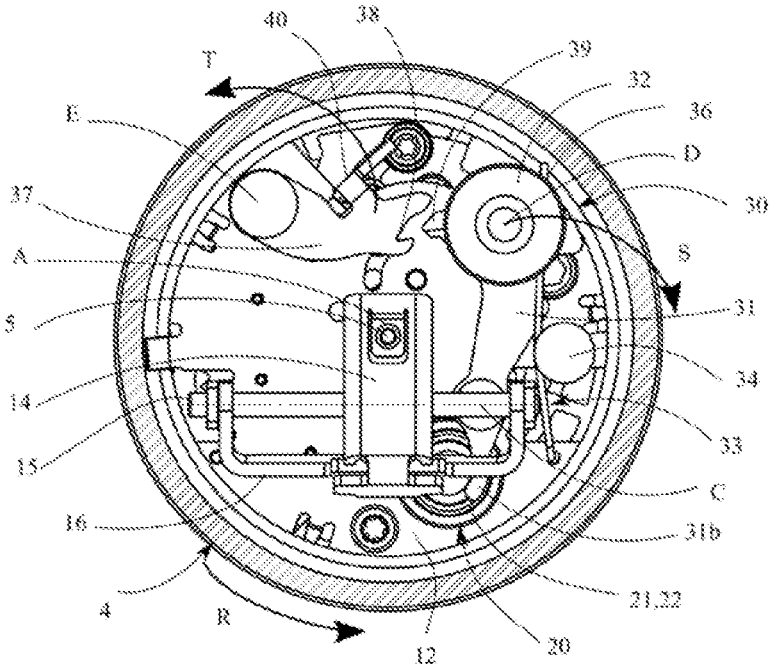
FIG. 8 is a view similar to FIG. 7 of the safety mechanism in an intermediate position.
Figure 9:
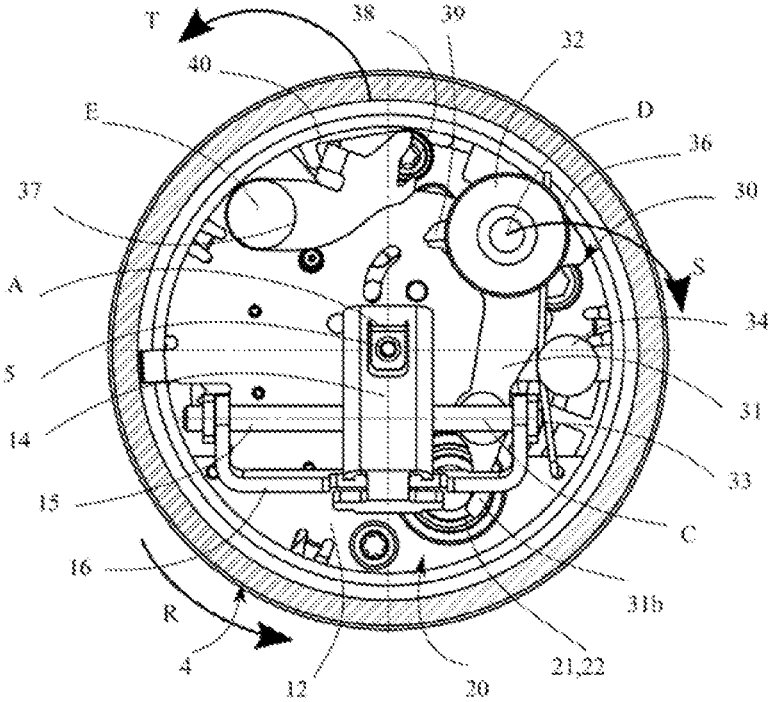
FIG. 9 is a view similar to FIG. 7 of the safety mechanism in the locked position.
Figure 10:
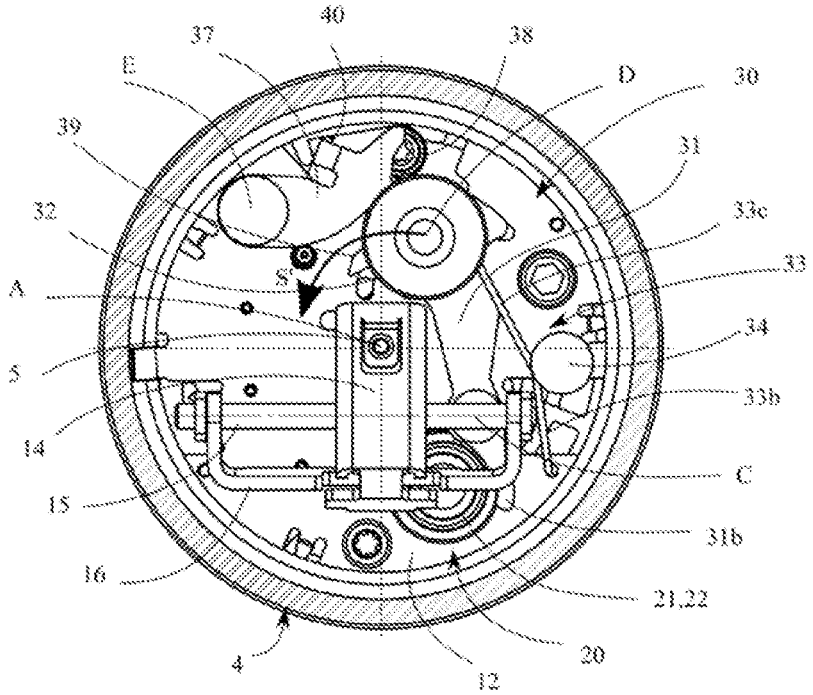
FIG. 10 is a view similar to FIG. 7 of the safety mechanism in the unlocked position.

FIGS. 7 to 9 illustrate the kinematics of the safety mechanism 30 switching from a storage position (FIG. 7) to a locked position (FIGS. 8 and 9) under the effect of the centrifugal force induced by the angular acceleration of the projectile 1 upon the departure of the shot. In the storage position, when the projectile 1 is at rest, the angular position of the locking lever 31 is such that its end forming a locking stop 31*b* is located outside the inertial body 21 of the SD mechanism 20, and that the centrifugal mass 32 it carries at its other end is brought close to the axis of symmetry A, and the return member 33 is prestressed. Upon the departure of the shot, the angular acceleration of the projectile 1 in a (counterclockwise) direction represented by the arrow R about the axis of symmetry A of the fuze 4, moves the centrifugal mass 32 outwardly by moving it away from the axis of symmetry A, causing the locking lever 31 to rotate about its pivot axis C in an opposite (clockwise) direction represented by the arrow S against the return member 33 (FIGS. 8 and 9). The locking lever 31 moves up to a peripheral stop 36 of the plate 12. During this movement, the locking stop 31*b*, opposite to the centrifugal mass 32, moves in the same direction S above the inertial body 21 of the SD mechanism 20, if and only if said inertial body 21 has meanwhile switched in the cocked position (FIG. 6). If the locking lever 31 has been able to move, it blocks and keeps the SD mechanism 20 in the cocked position throughout the entire duration of the flight of the projectile and as long as the rotational speed of the projectile 1 is enough. During this movement, the return member 33 is compressed and stores a reserve of kinetic energy capable of ensuring the return of the locking lever 31 in the unlocked position (FIG. 10), to release the self-destruction function of the SD mechanism 20 (FIG. 12). It is important to highlight that the rotation of the locking lever 31 is possible only in the event of retraction of the inertial body 21 in the cocked position. Indeed, if the inertial body 21 has not undergone the effects of linear acceleration of the projectile 1, it prevents any rotation of the centrifugal lever 31. This condition allows guaranteeing that without the existence of an event which combines linear acceleration and angular acceleration, the projectile 1 is kept in a maximum safety state. The locking lever 31 via the storage lever 37 described later on allows blocking the rotation of the primer holder 60 and makes impossible a possible alignment of the primer 6 with the pyrotechnic chain.

The safety mechanism 30 further includes a storage lever 37 pivotally mounted about a pivot axis E parallel to the axis of symmetry A of the fuze 4, and substantially diametrically opposite to the pivot axis C of the locking lever 31. It is designed to successively adopt:

- an active position, corresponding to the storage position of the projectile 1, in which it retains the locking lever 31 in the storage position (FIG. 7) and the primer holder 60 in the safety position, and
- a passive position, throughout the entire duration of the intermediate, cocked and self-destruction positions of the projectile 1, in which it clears away relative to the locking lever 31 (FIGS. 8 and 9).

The storage lever 37 includes at its free end a blocking notch 38 arranged to receive a blocking tooth 39 with a complementary shape provided on the locking lever 31. The blocking tooth 39 protrudes radially from the end of the locking lever 31 carrying the centrifugal mass 32. It further includes a blocking lug 40, opposite the blocking notch 38, which extends in the direction of the primer holder 60 to fit into a blocking notch 64 of the actuation mechanism of the primer holder 60 described later on.

In the active position (FIG. 7), the locking lever 31 and the storage lever 37 are intimately linked by the blocking tooth 39 fitted into the blocking notch 38, thus forming self-locking means guaranteeing both keeping of the self-destruction device 7 in safety and keeping the primer holder 60 in safety, in the storage position of the projectile 1 during all of the phases preceding the departure of the shot.

Upon the departure of the shot, when the locking lever 31 moves under the effect of the angular acceleration of the projectile 1, the blocking tooth 39 escapes from the blocking notch 38 thanks to their respective curved shape, and releases the lever storage 37. This storage lever 37, being itself also subjected to centrifugal force, can move outward by moving away from the axis of symmetry A and by pivoting about its axis E in a direction of rotation opposite to the locking lever 31, represented by the arrow T. Thus, it switches from an active position to a passive position in which it will remain, as it is not subjected to any return member. During this time, the blocking lug 40 has left the blocking notch 64 releasing the actuation mechanism of the primer holder 60. The configuration of the illustrated and described storage lever 37 and self-locking means (blocking notch 38 and blocking tooth 39; blocking lug 40 and blocking notch 64) may vary subject to filling the same function.

Figure 11:
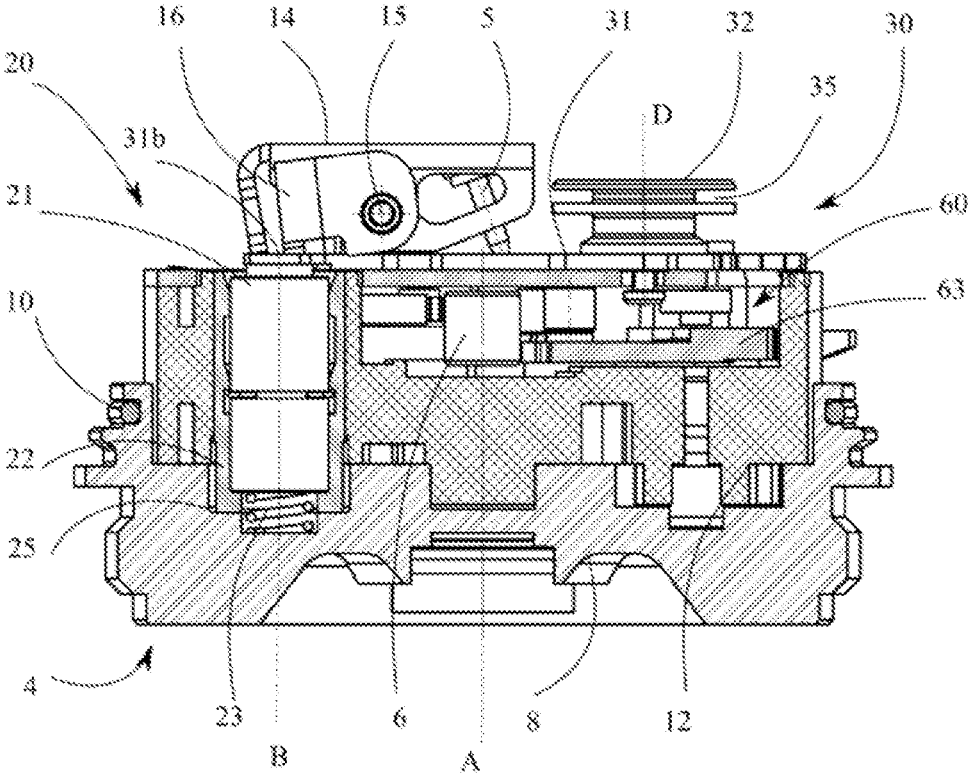
FIG. 11 is an axial sectional view of the self-destruction device of FIG. 3 in the cocked position.
Figure 12:
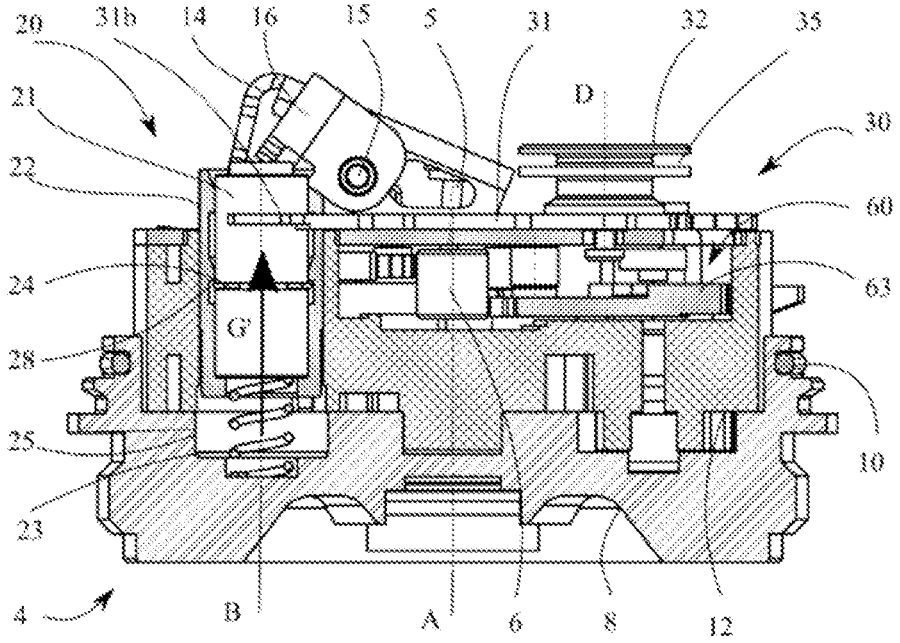
FIG. 12 is a view similar to FIG. 11 of the self-destruction device in the self-destruction position.

FIGS. 11 and 12 represent in axial section the self-destruction device 7 respectively in the cocked position and in the self-destruction position. During the flight of the projectile 1, the centrifugal effects related to its rotation keep the locking lever 31 in the locked position (FIG. 11). In this position, it keeps the inseparable assembly formed by the inertial body 21 and the sleeve 22 in the cocked position, preventing it from rising. Thus, during the flight of the projectile 1, it is the locking lever 31 which retains the self-destruction device 7 as long as the centrifugal effects are maintained.

Upon an impact, the projectile 1 undergoes a drop of rotational speed, the centrifugal effects then decrease very rapidly until they completely disappear. As soon as the centrifugal effects fall below the triggering threshold of the SD function, the centrifugal force is no longer enough to keep the return member 33 compressed. Thus, the triggering threshold is determined by the elastic force of said return member 33. The centrifugal mass 31 is then pushed towards the inside of the fuze 4 by the return member 33. It carries with it the locking lever 31 in rotation about its pivot axis C in the opposite direction represented by the arrow S'. The locking stop 31*b* then releases the SD mechanism 20, and the safety mechanism 30 is in the unlocked position (FIG. 10).

As soon as the locking lever 31 is in the unlocked position, the inseparable assembly formed by the inertial body 21 and the sleeve 22 could rise under the effect of the return member 23 which releases the kinetic energy stored upon the departure of the shot. The "inertial body 21 and sleeve 22" assembly moves upwards in the direction of the arrow G', and drives the inertial mass 16 which in turn rises by tilting about the rocker axis 15 (FIG. 12). The inertial mass 16 comes into contact with the striker holder 14 which also tilts about the rocker axis 15, and drives with it the striker 5 downwards. The striker 5 hits the primer 6 which initiates the pyrotechnic chain activating the explosive charge of the projectile 1. The projectile 1 is then destroyed by the self-destruction device 1 as soon as the rotational speed falls below a certain threshold.

Figure 13:
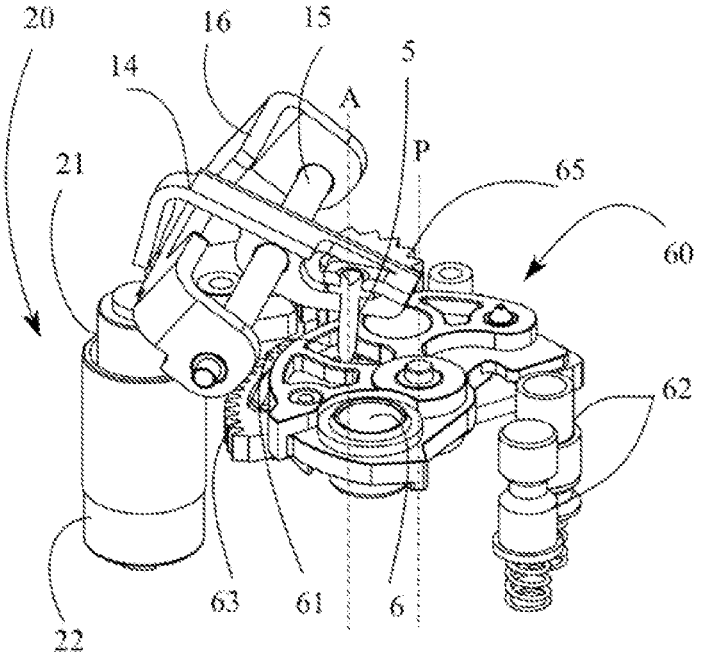
FIG. 13 is a perspective view of the primer holder and part of the self-destruction mechanism equipping the fuze of FIG. 2, in the storage position.
Figure 14:
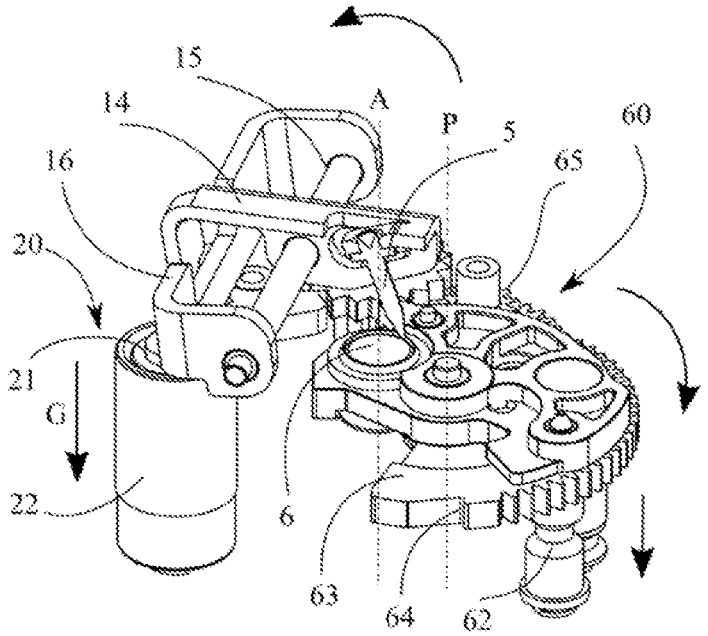
FIG. 14 is a view similar to FIG. 13, in the cocked position.

FIGS. 13 to 14 illustrate the primer holder 60 associated with its actuation mechanism in its different positions with respect to the successive positions of the striker holder 14:

- the storage position (FIGS. 3, 4, 11 and 13) in which the primer holder 60 is in the safety position, the primer 6 is eccentric with respect to the striker 5, the striker holder 14 is lowered and the tip of the striker 5 is received in the housing 61 of the primer holder 60 to prevent it from rotating,
- the standby position (FIGS. 11 and 14) in which the striker holder 14 is raised, the striker 5 releases the primer holder 60, and the primer holder 60 has rotated and is in a cocked position in which the primer 6 is aligned with striker 5, and
- the striking position (FIGS. 12 and 15) in which the striker holder 14 is lowered in the direction of the primer holder 60, the striker hits the primer 6 to initiate the pyrotechnic chain.

The primer holder 60 is rotatable about an axis of rotation P parallel to and away from the axis of symmetry A. It is associated with an actuation mechanism which includes at least a pair of inertial locks 62, a motor segment 63 and a timing train 65. The primer holder 60 is mechanically independent of the motor segment 63, which enables the projectile 1 to remain in safety over a defined safety distance. The pair of inertial locks 62 forms a safety for the actuation mechanism, which reacts only to the linear acceleration of the projectile 1. Thus, it blocks the rotation of the motor segment 63 and of the primer holder 60 as long as firing has not been done.

The motor segment 63 is an eccentric mass which reacts strongly to the centrifugal effects. When it is subjected to the centrifugal effects of the projectile 1 after the departure of the shot, it begins to rotate about its axis of rotation P. This rotation is subject to the fact that the storage lever 37 of the self-destruction device 7 has switched in a passive position (FIGS. 9 and 10) and that the blocking lug 40 has moved away from the locking notch 64 provided on the motor segment 63. The rotational speed of the motor segment 63 is regulated by a set of gear train or timing train 65. The rotational stroke of the motor segment 63 takes place in two portions. A first so-called "regulated" portion in which the motor segment 63 drives the timing train 65 over the defined safety distance. The primer holder 60 does not move and the primer 6 remains in the safety position in which it is off-axis. And a second so-called "instantaneous" portion which begins the second when the last tooth of the motor segment 63 comes off the timing train 65. At this time point, the defined safety distance has been overpassed, the motor segment 63 is no longer braked and could end its stroke almost instantaneously. It drives with it the primer holder 60 and instantly aligns the primer 6 in the axis of symmetry A.

The operation of the actuation mechanism associated with the primer holder 60 is simple and the self-destruction device 7 according to the invention contributes to keeping this mechanism in safety.

Of course, the present invention is not limited to the described embodiment but extends to any modification and variant obvious to a person skilled in the art within the limits of the appended claims.

The invention claimed is:

1. A fuze including a self-destruction device for a gyratory projectile, said fuze consisting of a hollow body, defined by an axis of symmetry coinciding with the axis of rotation of said projectile, and including a striker associated with a striker holder, a primer associated with a primer holder, and said self-destruction device arranged to cooperate with said striker holder and said primer holder to successively generate a first position called "storage position" before firing the projectile, in which the primer is misaligned with respect to the striker, a second position called "intermediate position" upon the departure of the projectile, in which the striker holder is away from the primer holder, a third position called "cocked position" during the flight of the projectile, in which the primer is aligned with the striker, and a fourth position called "self-destruction position" at the end of the flight, in which the strike holder is folded down on the primer holder so that the striker hits the primer and initiates a pyrotechnic chain contained in the projectile, wherein said striker holder is rotatable about a pendulum axis perpendicular to said axis of symmetry, and wherein said primer holder is rotatable about an axis of rotation parallel to said axis of symmetry, and wherein said self-destruction device includes an SD mechanism and a safety mechanism arranged to cooperate, and wherein said SD mechanism includes an axial inertial body urged by a return member and arranged to use the linear acceleration of the projectile upon the departure of the projectile, store axial kinetic energy and cause a switch from said storage position to said intermediate position in which said SD mechanism releases the striker holder so that the striker holder moves away from the primer holder, and wherein said safety mechanism includes a centrifugal lever urged by a return member and arranged to use a centrifugal effects of the projectile during the flight, store radial kinetic energy and cause a switch from said intermediate position to said cocked position in which said safety mechanism locks said SD mechanism, and wherein said safety mechanism is further arranged, at the end of the flight, as soon as the centrifugal force induced by the rotation of the projectile drops below a determined threshold, to cause a switch from said cocked position to said self-destruction position in which said safety mechanism restores the stored radial kinetic energy and unlocks said SD mechanism so that, in turn, said SD mechanism restores the stored axial kinetic energy and folds the striker holder back onto the primer holder to strike the primer.

2. The fuze according to claim 1, wherein the inertial body of said SD mechanism extends over an axis parallel to said axis of symmetry so that the rocker axis of said striker holder is positioned between the two axes and, and wherein said inertial body is movable in the axis between an extended position in which the inertial body pushes the striker holder in the direction of the primer holder, and a retracted position in which the inertial body releases the striker holder, said extended position corresponding to the storage and self-destruction positions, and said retracted position corresponding to the intermediate and cocked positions, and wherein said inertial body is arranged to move in a direction opposite to the direction of linear acceleration of the projectile from an extended position to a retracted position by compressing said return member to store axial kinetic energy upon the departure of the projectile, and wherein said return member is arranged to move said inertial body in the opposite direction (G') from a retracted position to an extended position by decompressing to restore said axial kinetic energy stored at the end of firing.

3. The fuze according to claim 2, wherein said striker is carried at one end of said striker holder located opposite said inertial body with respect to said rocker axis, and wherein said primer holder includes a housing remote from said primer, said housing being arranged to be aligned with said striker in said storage and intermediate positions, so that in the storage position, said striker holder is folded down towards said primer holder, and said striker enters said housing and blocks said primer holder.

4. The fuze according to claim 3, wherein said self-destruction device further includes an inertial mass pivotally mounted around said rocker axis, consisting of a part separate from said striker holder, disposed between said inertial body and said striker holder and arranged to transmit to said striker holder either the axial kinetic energy restored by said SD mechanism in said self-destruction position, or the specific kinetic energy that said inertial mass has stored and that said inertial mass restores in the event of strong linear deceleration of said projectile upon an impact.

5. The fuze according to claim 1, wherein the centrifugal lever of said safety mechanism is pivotally mounted around a pivot axis parallel to said axis of symmetry, between an unlocked position in which the centrifugal lever releases the inertial body and a locked position in which the centrifugal lever blocks the inertial body in a retracted position, the unlocked position corresponding to said storage and self-destruction positions, and the locked position corresponding to said cocked position, and wherein said centrifugal lever is arranged to move radially in one direction from an unlocked position to a locked position under the centrifugal effects of the projectile by compressing said return member to store radial kinetic energy during the flight, and wherein said return member is arranged to move said centrifugal lever in the opposite direction from a locked position to an unlocked position by decompressing to restore said stored radial kinetic energy at the end of firing when the centrifugal force is less than the elastic force of said return member.

6. The fuze according to claim 5, wherein the centrifugal lever of said safety mechanism includes two segments disposed on either side of the pivot axis of the centrifugal lever, a first segment able to carry a centrifugal mass, and a second segment forming a locking stop to bock the inertial body in a retracted position, the pivot axis being close to the axis of said inertial body so that the length of said first segment is larger than the length of said second segment.

7. The fuze according to claim 6, wherein the return member of said safety mechanism consists of a torsion spring mounted on a fastening stud with an axis parallel to said axis of symmetry, and provided with a fixed end relative to the body of said fuze, and with a movable end coupled to said centrifugal lever to urge the centrifugal lever into the unlocked position.

8. The fuze according to claim 1, wherein said self-destruction device includes a storage lever pivotally mounted around a pivot axis parallel to said axis of symmetry, between an active position in which the storage lever blocks said centrifugal lever in an unlocked position corresponding to said storage position, and a passive position in which the storage lever retracts relative to said centrifugal lever when the latter moves into a locked position corresponding to said cocked position.

9. The fuze according to claim 8, wherein said storage lever includes a blocking lug arranged to block said primer holder in a safety position corresponding to said storage position, when said storage lever is in an active position.

10. The fuze according to claim 8, wherein said storage lever and said centrifugal lever respectively include self-locking means arranged to cooperate only when said storage lever is in an active position and said centrifugal lever is in an unlocked position.

11. The fuze according to claim 10, wherein said self-locking means are provided respectively in an end area of said storage lever opposite the pivot axis of said storage lever and in an end area of said centrifugal lever opposite the pivot axis of said centrifugal lever, and wherein said storage and centrifugal levers are arranged to pivot about their respective pivot axis in opposite directions of rotation under the effect of said centrifugal force of the projectile.

12. The fuze according to claim 11, wherein said self-locking means include a blocking tooth provided on one of the storage or centrifugal levers, and a blocking notch provided on the other one of the centrifugal or storage levers, the blocking tooth being arranged to escape from the blocking notch when said centrifugal lever moves into a locked position, which is only possible in said cocked position.

13. The fuze according to claim 1, wherein the body of said fuze includes an impact disc coaxial with the axis of symmetry, disposed between the top of the body of said fuze and the striker holder, and arranged to deform in the event of direct impact of the projectile on a target, and fold said striker holder back on the primer holder to strike the primer.

* * * * *